US007430763B1

(12) United States Patent
Santos

(10) Patent No.: US 7,430,763 B1
(45) Date of Patent: Oct. 7, 2008

(54) VISOR MOUNTED FACE PROTECTOR

(76) Inventor: Jorge Santos, 531 Barbri La., Davie, FL (US) 33325

( * ) Notice: Subject to any disclaimer, the term of this patent is extended or adjusted under 35 U.S.C. 154(b) by 65 days.

(21) Appl. No.: 11/670,155

(22) Filed: Feb. 1, 2007

(51) Int. Cl.
*A42B 3/00* (2006.01)

(52) U.S. Cl. ..... 2/9; 2/424

(58) Field of Classification Search ..... 2/9, 2/10, 410, 411, 425, 424
See application file for complete search history.

(56) References Cited

U.S. PATENT DOCUMENTS 2,100,553 A * 11/1937 Schutt ..... 2/9
5,335,371 A * 8/1994 Spessard ..... 2/9
5,477,565 A * 12/1995 Hunt, Jr. ..... 2/423
5,544,361 A 8/1996 Fine et al. ..... 2/10
5,661,849 A * 9/1997 Hicks ..... 2/9
6,499,139 B1 * 12/2002 Brown et al. ..... 2/9
6,584,614 B2 7/2003 Hogg ..... 2/10
6,598,234 B1 * 7/2003 Brown et al. ..... 2/9
6,708,339 B1 * 3/2004 Smith, Jr. ..... 2/9
6,978,477 B2 * 12/2005 Foote ..... 2/9
6,983,488 B2 * 1/2006 Foote et al. ..... 2/10
D517,250 S * 3/2006 Polstein ..... D29/122
2003/0074708 A1 * 4/2003 Hogg ..... 2/9
2003/0126665 A1 * 7/2003 Brown et al. ..... 2/9
2005/0204446 A1 * 9/2005 Wright ..... 2/9

* cited by examiner

*Primary Examiner*—Danny Worrell
(74) *Attorney, Agent, or Firm*—Sanchelima & Assoc., P.A.

(57) ABSTRACT

A face protector with at least three curved rigid members perpendicularly mounted to two lateral rigid members. A compartment or space is defined by two spaced apart T-shaped guiding members that receive the bill of a cap. One of the legs of the T-shaped guiding members are commonly mounted to a central portion of the uppermost rigid member. The bill of a cap, with an adjustable head strap, keeps the face protector in place.

4 Claims, 2 Drawing Sheets

VISOR MOUNTED FACE PROTECTOR

BACKGROUND OF THE INVENTION

1. Field of the Invention

The present invention relates to a visor mounted face protector, and more particularly, to such a protector that is used with a visor.

2. Description of the Related Art

Several designs for face protectors have been designed in the past. Specially, those used in different sports. None of them, however, includes a mechanism for coacting with a visor to support the face protector. Without the visor support, face protectors slide down from a user's face upon the occurrence of sudden movements and/or sweat. Also, the invention permits a user to continue using his cap and visor which is typically not compatible with conventional face protectors. Finally, the present invention also includes a mechanism for absorbing a portion of the impact through the relatively flexible visor.

Applicant believes that the closest reference corresponds to U.S. Pat. No. 5,544,361 issued to Fine et al. on Aug. 13, 1996 for a Headgear Mountable Protective Shield. However, it differs from the present invention because Fine's patented device requires the use of jaws 22 and 24 to secure shield 16 to bill 14 of cap 12. It also requires additional reinforcement using retaining clips 38. Not only are these moving parts more complicated and burdensome on the user but the structural engagement is poor.

Another references corresponds to U.S. Pat. No. 6,584,614 issued to Hogg on Jul. 1, 2003 for a Face Protector that includes a top pocket 8 that receives a cap bill. However, it differs from the present invention because it teaches supporting the face protector from the edge of the cap bill and the weight of the face protector will exert a leveraged downwardly force on the cap displacing it. The present invention, on the other hand, entraps the cap bill completely and the supporting force comes from the position of the bill adjacent to the cap. This results in a more stable supporting structure.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a face protector compatible with caps with visors that support the former.

It is another object of this invention to permit a user to use a face protector while keeping his team's cap with the cap's visor received within a portion of the face protector.

It is still another object of the present invention to provide a face protector that does not come in contact with the user's face except the chin area.

It is still another object of the present invention to provide a face protector that protects the user from the elements, including rain and sun It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
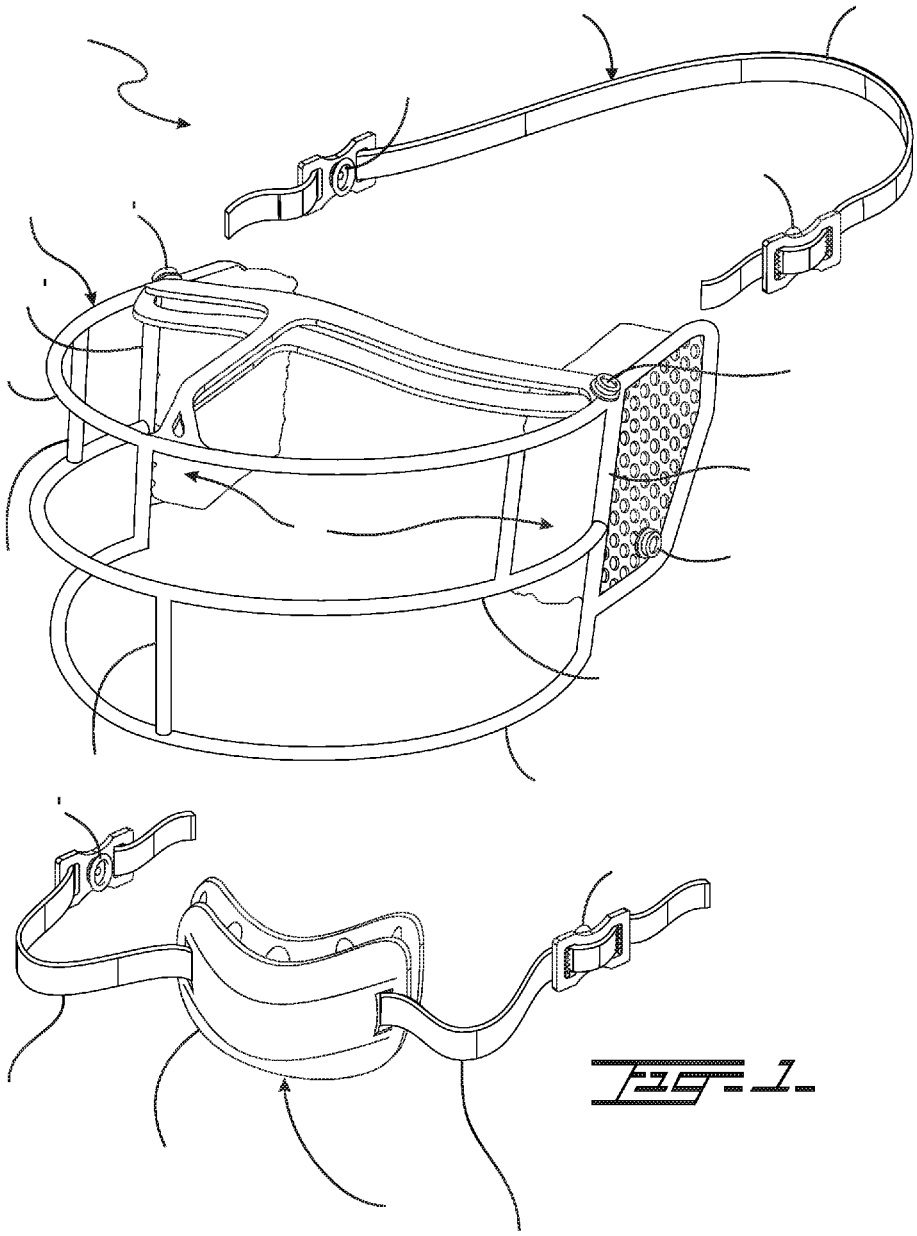
FIG. 1 represents an isometric view of an embodiment for the present invention.
Figure 2:
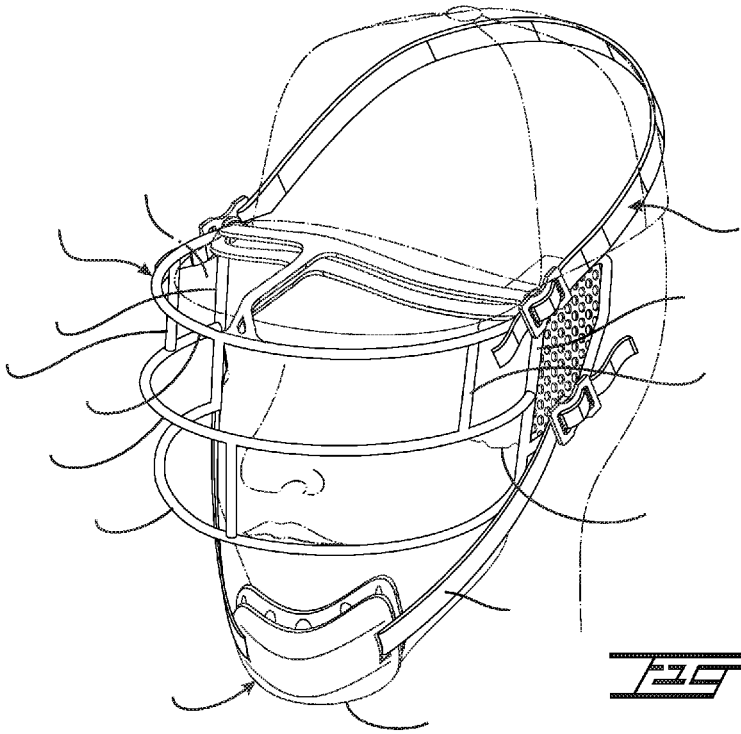
FIG. 2 shows an isometric view of a person wearing the face protector shown in FIG. 1.
Figure 3:
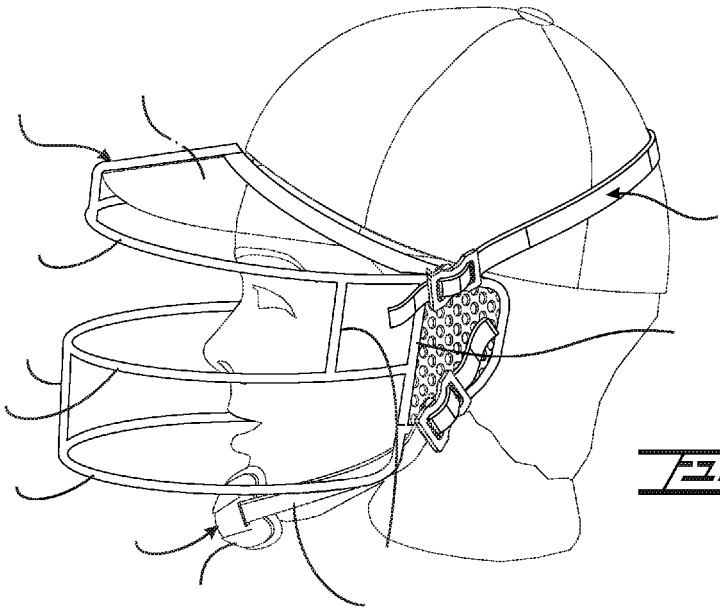
FIG. 3 illustrates a side elevational view of the face protector of the present invention.

Referring now to the drawings, where the present invention is generally referred to with numeral 10, it can be observed that it basically includes a face mask assembly 20, head strap assembly 40, chin strap pad assembly 60 and cushion assembly 70. Face protector 10 is used with caps or visors V that include a bill.

Face mask assembly 20 includes, in one of the preferred embodiments, lower rigid member 22, intermediate rigid member 24 and upper rigid member 26 that are curved and spaced apart from each other. Members 22; 24 and 26 include two ends each. Spacer members 29 are mounted substantially perpendicularly between two of said members 22; 24 and 26 to enhance their structural integrity. These ends are rigidly mounted to lateral rigid members 28 and 28', that are also kept at a parallel and spaced apart relationship with respect to each other, as best seen in FIG. 1.

Head strap assembly 40 includes flexible strap member 42 with two ends. Slidably positioned over member 42 are female snap button assemblies 44 and 44'. Assemblies 44 and 44' cooperatively mate with male snap button assemblies 38 and 38', respectively. Chin strap assembly 60 includes flexible strap member 62 and chin support pad 64 with female snap button assemblies 66 and 66', respectively, that are removably receivable with male snap button 36.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A face protector, comprising:

A) first and second lateral rigid members kept at a parallel and spaced apart relationship with respect to each other and each of said lateral rigid members including first and second ends;

B) at least three curved rigid members, each having third and fourth ends, said curved rigid members kept at a parallel and spaced apart relationship with respect to each other, said third ends being rigidly and substantially perpendicularly mounted to said first lateral rigid member and said fourth ends being rigidly and substantially perpendicularly mounted to said second lateral rigid members;

C) upper and lower rigid T-shaped guiding members, kept at a parallel and spaced apart relationship with respect to each other, defining a space between said T-shaped guiding members and each T-shaped guiding member includes fifth, sixth and seventh ends, said fifth and sixth ends being rigidly mounted to said first ends of said first and second lateral rigid members, said seventh ends being rigidly mounted to the uppermost curved rigid member;

D) head strap means for removably holding said face protector against a user's face; and E) a cap with a bill that is removably housed within said space so that said bill provides support to said upper rigid T-shaped guiding members.

2. The face protector set forth in claim 1 further including:

E) cushion means rigidly and cooperatively mounted to said lateral rigid members to protect a user's sensitive parts.

3. The face protector set forth in claim 2 further including:

F) guard means for protecting a user's chin and mounted to said cushion means.

4. The face protector set forth in claim 3 further including at least one spacer means for reinforcing the structural disposition of said at least three curved rigid members.

* * * * *